United States Patent [19]

DeRoss et al.

[11] 4,143,936

[45] Mar. 13, 1979

[54] ELECTRICAL CONTACT

[75] Inventors: Robert DeRoss, Cicero; Leonard Kaczmarek, Wonder Lake, both of Ill.

[73] Assignee: Bunker Ramo Corporation, Oak Brook, Ill.

[21] Appl. No.: 856,428

[22] Filed: Dec. 1, 1977

[51] Int. Cl.[2] ..... H01R 11/08

[52] U.S. Cl. ..... 339/276 T; 339/95 R

[58] Field of Search ..... 339/95 R, 97 C, 276; 174/84C

[56] References Cited

U.S. PATENT DOCUMENTS

| | | | |
|---|---|---|---|
| 3,058,088 | 10/1962 | Miller | 174/84 C |
| 3,157,454 | 11/1964 | Collins | 339/276 T |
| 4,018,499 | 4/1977 | Rickards | 339/97 C |

*Primary Examiner*—Joseph H. McGlynn
*Attorney, Agent, or Firm*—William Lohff; F. M. Arbuckle

[57] ABSTRACT

An electrical contact adapted to be crimped onto an electrical conductor is disclosed. The contact comprises a body portion having an active contact element disposed at one end for connection to a complementary contact and a terminal element at the other end adapted to be fixedly connected to a conductor. The terminal contact element comprises a pair of spaced crimping arms disposed in a common plane and having opposite inside facing edges with beveled surfaces. The beveled surfaces provide a camming action during the crimping operation which permits the arms to pass one another and to completely encircle the conductor, while the arts remain in substantially the same plane, whereby the crimped arms provide a positive mechanical and electrical termination between the contact and the conductor. The bight of the terminal element disposed between the spaced arms defines an edge generally perpendicular to the inside edges of the arms such that the slot defined by the inside edges of the arms and the bight is generally rectangular whereby the connector may be crimped about electrical conductors of different cross sectional configurations and dimensions.

16 Claims, 11 Drawing Figures

FIG. 7
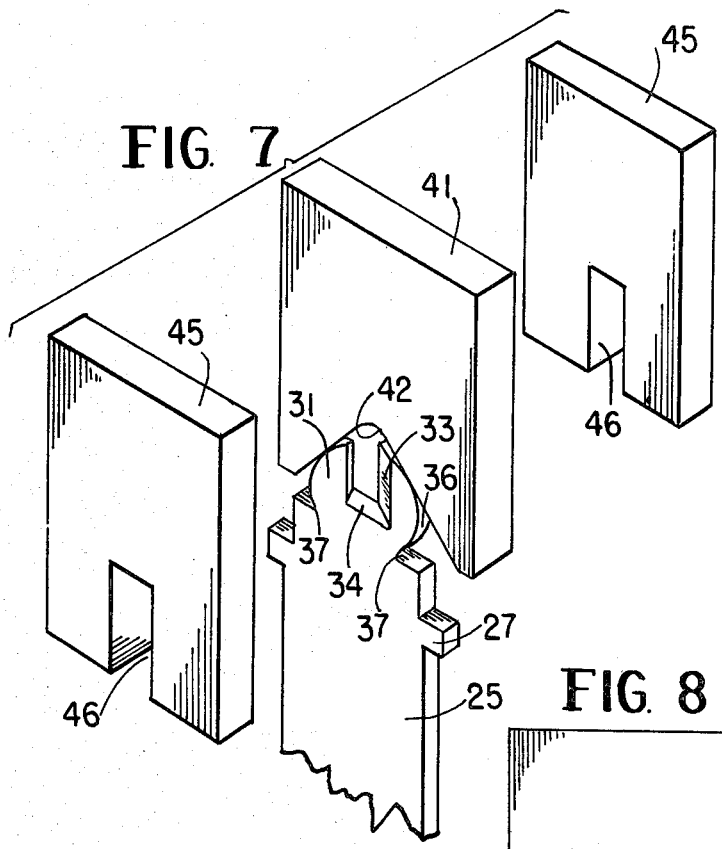
FIG. 8
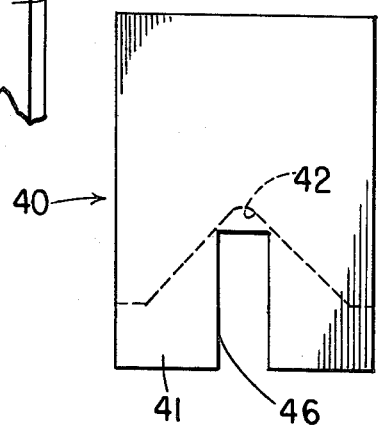
FIG. 3
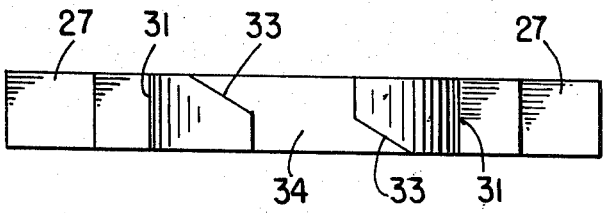
FIG. 4
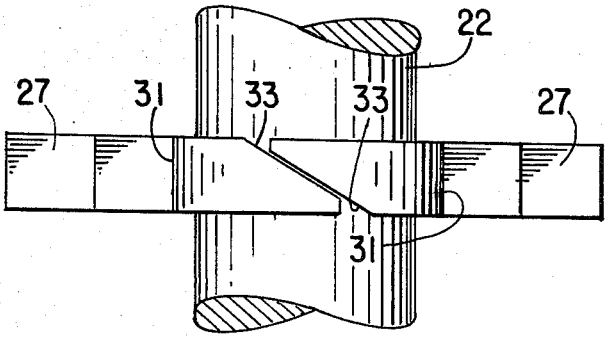
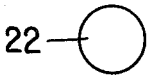
FIG. 9
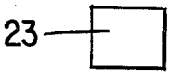
FIG. 10
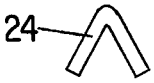
FIG. 11

ELECTRICAL CONTACT

BACKGROUND OF THE INVENTION

The present invention is directed to an electrical contact designed to effect a crimp termination to an electrical conductor. More particularly, the invention relates to an electrical contact having a generally planar terminal element which is crimped to a conductor while maintaining its planar configuration whereby the contact may be disposed generally perpendicular to the axis of the conductor.

Crimp-type electrical contacts are well known and have been developed for termination with electrical conductors without the need of solder or other fastening means. One form of crimp contact constitutes a ferrule type of crimp wherein the crimp arms encircle the conductor along the axis thereof, with the active contact portion of the connector extending in the same plane as the axis of the conductor. One disadvantage attendant to such a crimp contact is that upon repeated engagement of the active contact portion of the contact with a complementary contact the crimp termination may tend to loosen, thus impairing or breaking the circuit intended to be achieved thereby. Moreover, such contacts generally require a crimping tool having an anvil portion to appropriately grasp and support the contact, in which event such contacts must be preassembled to the conductor prior to mounting in a connector housing.

In addition, the prior art crimp-type contacts are generally useful with limited configurations of conductors. This often requires the use of a plurality of different size contacts to accommodate electrical components utilizing different sizes and configurations of conductors.

SUMMARY OF THE INVENTION

Accordingly, the present invention is directed to a unique electrical contact adapted for crimping onto an electrical conductor.

More particularly, an important feature of the present invention is the provision of an electrical contact in which the crimping arms, after crimping, will be disposed in a plane generally perpendicular to the axis of the associated electrical conductor while effecting a positive mechanical and electrical termination.

An important feature of the present invention is the provision of a crimp-type electrical contact capable of being fixedly secured to electrical conductors of different cross sectional configurations and/or dimensions.

Another feature of the present invention is the provision of a crimp-type electrical contact which may be conveniently secured to an electrical conductor by the use of a simple crimping tool and which provides a complete encirclement of the associated conductor in a rigid and positive fashion.

The contact of the present invention generally comprises a body portion having an active contact element disposed at one end for connection to a complementary electrical contact and a terminal element at the other end adapted to fixedly connect to a conductor. The terminal element includes a pair of spaced crimping arms disposed in a common plane such that, upon crimping, the arms will be perpendicular to the axis of the conductor. The opposite inside facing edges of the crimping arms are provided with beveled surfaces to provide a camming action permitting the arms to pass one another and to completely encircle the conductor, while the arms remain in substantially the same plane. This structure provides a positive mechanical and electrical termination between the contact and the conductor, while requiring only a small longitudinal portion of the conductor. The bight of the terminal element disposed between the spaced crimping arms defines an edge generally perpendicular to the inside edges of the crimping arms so that the slot defined by these edges is generally rectangular, whereby the connector may be crimped about electrical conductors of different cross sectional configurations and dimensions. The crimping arms have a generally circular outer peripheral configuration and a specific geometry such that upon crimping the arms will, in conjunction with the rectangular slot, fold completely about and encircle the associated conductor with the conductor being held in the bottom or bight portion of the slot thereby assuring complete contact between the crimping arms and the conductor.

BRIEF DESCRIPTION OF THE DRAWINGS

The features of the present invention which are believed to be novel are set forth with particularity in the appended claims. The invention itself, however, together with further objects and advantages thereof, may best be understood by reference to the following description, taken in connection with the accompanying drawings, in which:

FIG. 3 is an end elevational view of the electrical contact taken along line 3—3 in FIG. 2;

FIG. 4 is an end elevational view similar to that of FIG. 3 showing the electrical contact after crimping to a conductor;

FIG. 7 is an exploded perspective view of a tool which may be used to effect the crimping of the electrical contact of the present invention;

FIG. 8 is a side elevational view of the crimping tool as assembled; and

FIGS. 9 through 11 are cross sectional views of representative electrical conductors which may be terminated by the electrical contact of the present invention.

DESCRIPTION OF THE PREFERRED EMBODIMENT

Figure 1:
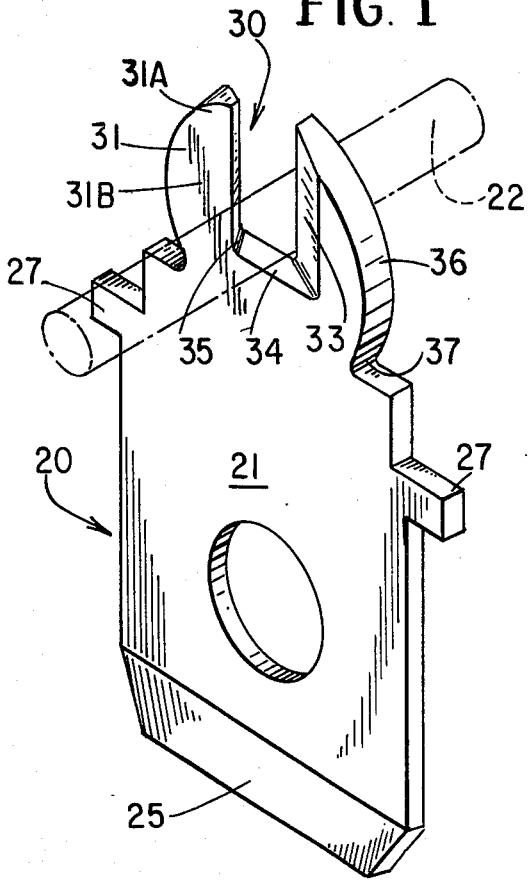
FIG. 1 is an enlarged perspective view of a crimp-type electrical contact constructed in accordance with and embodying the features of the present invention.

Illustrated in the drawings is a crimp-type electrical contact made in accordance with the present invention and designated generally by the numeral 20.

The contact 20 comprises a generally elongaged metal member, preferably stamped from tin plated brass or other sheet metal stock, having a body portion 21, and an active contact element 25 extending from one end thereof and which, in the disclosed embodiment, is in the form of a flat blade or spade configuration, adapted to be electrically connected to a compatible electrical recepticle contact.

Figure 2:
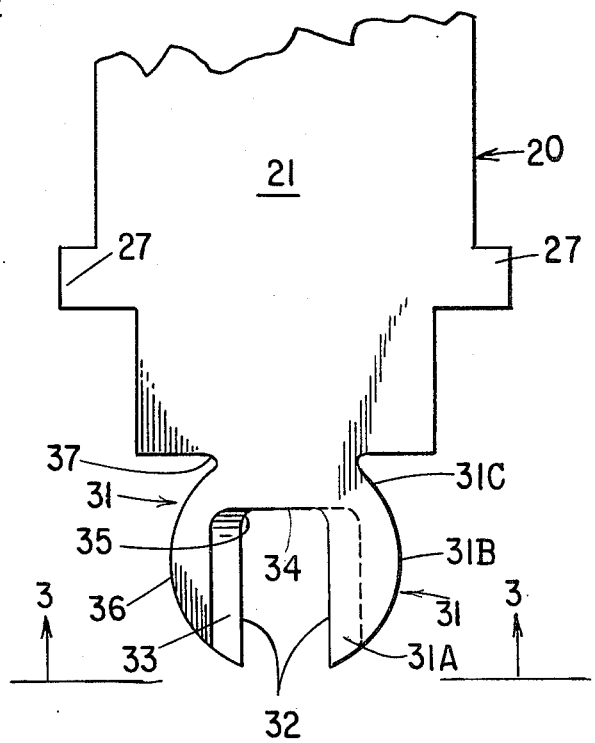
FIG. 2 is a fragmentary plan view of the preferred form of electrical contact constructed in accordance with the present invention.

The contact 20 has a terminal element designed generally by the numeral 30, disposed at the opposite end of the body portion 21 and adapted to be fixedly connected to a conductor, as illustrated in dashed lines in FIG. 1 and identified by numeral 22. The terminal element 30 is best illustrated in FIGS. 2, 3 and 4 and includes a pair of oppositely disposed and spaced crimping arms 31 integrally formed with and extending outwardly from the intermediate body portion 21 of contact 20. Each arm 31 includes an inside edge 32 which terminates at an intermediate bight portion or edge 34 disposed generally perpendicular to the inside edges 32 of the crimping arms 31. The inside edges 32 and the bight edge 34 define a generally rectangular, open-ended slot adapted to receive the conductor 22 therein. An important feature of the present invention is the fact that the bight edge 34 is normal to the slot defined by the crimped arms 31 so as to provide a rectangular slot rather than a circular slot, for reasons hereinafter explained.

Figure 6:
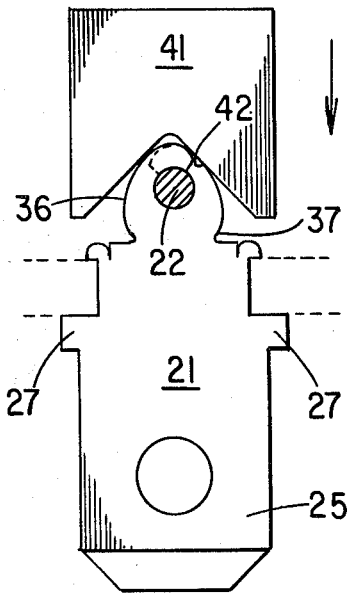

Each crimping arm 31 also has beveled surfaces 33 extending from the edges 32 and an opposing face thereof. During the crimping operation, the beveled surfaces 33 provide a camming action permitting the oppositely disposed arms 31 to pass one another in a scissors effect, and thereby wrap around and encircle the conductor 22 lying therebetween, as shown in FIGS. 4 and 6. At the same time, after crimping, the arms 31 will remain in substantially the same plane thereby providing a positive mechanical and electrical connection between the contact 20 and the conductor 22. Because the arms 31 completely encircle the conductor, and lie substantially in the same plane, the crimping forces are distributed generally uniformly about the conductor and also assure substantially uniform electrical contact. Moreover, the scissors effect promotes wrapping of the conductor to enhance the rigidity of the connection and also increases the total force applied to the conductor.

As can be seen most clearly in FIG. 2, each arm 31 includes a distal end portion designated 31 A, a larger, mid portion 31 B, and a narrower base portion adjacent to the bight 34 designated generally by the numeral 31 C. This specific configuration is necessary to facilitate proper crimping. Thus, in order that each arm 31 folds first at its base to thereby assure complete encapsulation of the conductor, it is necessary that the planar dimension be less at the base portion 31 C than that at the mid portion 31 B. To provide this desired relationship, the illustrated preferred embodiment includes crimping arms 31 having outer, peripheral edges 36 with a generally circular configuration, the peripheral edges terminating at the body portion 21 in a narrow neck region 37. The circular configuration results in the planar dimension of each arm 31 adjacent to the bight edge 34, at the area designated 31 C, to be less than the planar dimension of each arm 31 at the larger or median portion 31 B, whereby crimping of the arms 31 will be initiated at the base of the arms. On the other hand, the dimension across the base of each arm 31 must be sufficient to withstand the vertical forces applied to the arms 31 during crimping and to thereby prevent outward collapse of the arms. This minimum dimension will, of course, depend upon the size of the contact and the material from which it is fabricated.

It also is desirable that the bight edge 34 be disposed between the neck region 37 and the distal ends 31 A of the arms 31. This arrangement assures that the arms 31 will fold about the associated conductor 22 at a point substantially adjacent to the bight edge 34. If the bight edge 34 were disposed further toward the body portion 21, with the neck region being between the bight edge 34 and the distal ends 31 A of the crimp arms 31, the arms would tend to fold at the neck region first, which might result in a gap between the conductor and the contact.

The generally flat bight edge 34 of the slot defined by the arms 31 assures that the arms 31 will encapsulate or completely fold around the conductor, whereas a round bottom slot might tend to force the lead upwardly within the slot as crimping takes place, particularly in those instances where the conductor being crimped is not circular in cross section. On the other hand, where a circular conductor is being terminated a rounded edge 34 would be acceptable. To further facilitate crimping about conductors of various configurations, the intersections of the beveled surfaces 33 of the inside edges 32 with the bight edge 34 are preferably slightly radiused to accommodate a conductor having a very small cross sectional configuration and yet also assure effective rotation of the crimping arms 31 about the conductor.

Figure 5:
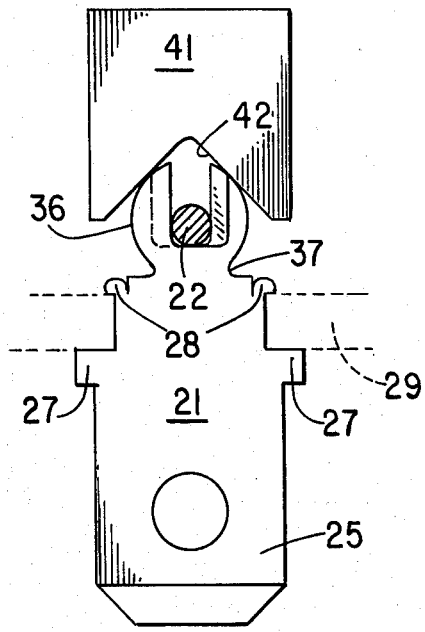
FIGS. 5 and 6 are side elevational views of the electrical contact of the present invention with a crimping tool, and illustrating the relative position of the crimping tool before and during the crimping operation.

Completing the description of the contact 20, it will be seen in FIG. 5 that the intermediate body portion 21 includes a pair of outwardly extending and integrally formed shoulders 27 thereon. The shoulders 27 facilitate mounting of the contact relative to an associated connector housing 29 (shown in phantom lines). Once the body portion 21 is inserted through the housing 29, staking flanges 28 may be struck therefrom to firmly lock the contact 20 in place. Moreover, this configuration permits the use of a simple tool to effect crimping of the arms 31 around the associated conductor 22 with the use of a crimping anvil or support directly below the crimp terminal itself.

One such semiconductor mounting structure or housing with which the present contact is particularly useful is that disclosed and claimed in the copending U.S. patent application, Ser. No. 833,112, entitled "SEMICONDUCTOR MOUNTING ASSEMBLY" filed in the name of Robert W. DeRoss and assigned to the same assignee as the present invention.

In those instances where the contact 20 is fixed to an insulative housing, the conductor may be crimped in place with an associated very simply formed crimping tool 40 such as that illustrated in FIGS. 5-8.

The crimping tool, designated generally by the numeral 40, consists of a sandwich-like structure having a middle die 41 therein. The die 41 is of a thickness slightly greater than the thickness of the crimping arms 31 of the contact 20 and has a generally triangular slot 42 formed therein, the slot having a base dimension greater than the diameter of the circle circumscribing the crimping arms 31. It will thus be appreciated with reference to FIGS. 5 and 6, that upon placement of the crimping tool 40 with the slot 42 of the die 41 overlying the peripheral edges 36 of the crimping arms 31, and the application of downward pressure as illustrated by the arrow in FIG. 6, the tool will cause the crimp arms 31 to rotate inwardly and completely fold over and encircle the conductor 22.

While the tool 40 would operate only with the crimp plate 41, it is desirable to maintain the crimp arms 31 in substantially the same plane after crimping as they lie in prior to crimping. This helps to enhance the mechanical and electrical connection with the conductor and minimize the amount of space occupied by the contact in those instances where the contact is used in conjunction with a small connector housing. To help meet these requirements, the crimping tool 40 may be provided with a pair of outside plates 45 fixedly secured to the crimp plate 41. Each outside plate includes a slot preferably of generally the same cross sectional dimensions as the rectangular slot defined by the inside edges 32 and bight edge 34 of the contact 20. Of course, the tool 40 can be used with the same variety of electrical conductors as can the crimp contact 20, itself.

As may be appreciated, the particular electrical contact 20 disclosed herein is capable of use with conductors of different cross sectional configurations and dimensions, including those illustrated as 22–24 in FIGS. 9–11.

As will be observed, not only is the contact 20 of the present invention useful to terminate conductors of different cross sections, it has also been found that the rectangular slot and the disclosed arm configuration permits use of the contact with conductors of substantially different dimensions.

It thus will be apparent that there has been disclosed herein a unique crimp-type electrical contact for solderless termination to electrical conductors of different cross sectional configuration and dimension. The electrical contact disclosed herein assures a positive mechanical and electrical termination with the associated electrical conductor while allowing the termination to be effected after the contact has been assembled to a connector housing.

While the particular contact 20 illustrated herein utilizes a flat blade or spade configuration for its active contact element, it should of course be understood that the active contact element may be in the form of a generally circular rod or pin such as the type of contact used in printed circuit boards, or any one of a variety of configurations well known to those skilled in the art.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. An electrical contact adapted to be crimped to an electrical conductor, said contact comprising a body portion having an active contact element disposed at one end for engagement with a compatible contact and a terminal element at the other end adapted to be fixedly connected to a conductor, said terminal element comprising a pair of spaced crimping arms disposed in a common plane, said arms including inside facing edges having beveled surfaces offset relative to one another such that upon crimping of said arms the beveled surfaces provide a camming action permitting said arms to pass one another to encapsulate the conductor while said arms remain in substantially the same plane, whereby the crimped arms provide a positive mechanical and electrical interconnection between the contact and the conductor.

2. The electrical contact set forth in claim 1, wherein said active contact element is generally flat and elongated to provide a spade-type contact for interconnection with said compatible contact.

3. The electrical contact set forth in claim 1, wherein said body portion includes means for securing said contact to an associated connector housing.

4. An electrical contact comprising:

an elongated body portion, an active contact element disposed at one end of said body portion for connection to a complementary contact and a terminal element at the other end of said body portion adapted to be fixedly connected to an electrical conductor, said terminal element comprising a pair of spaced crimping arms disposed in a plane such that upon crimping said arms will be generally perpendicular to the axis of the conductor about which said arms are crimped, said arms including means for overlapping one another during crimping thereby to completely encapsulate the conductor, whereby the crimped arms provide a positive mechanical and electrical connection, said crimping arms including generally straight inside edges which terminate at a common bight edge generally perpendicular to the inside edges, the inside edges of said bight edge defining a generally rectangular slot whereby said contact may be crimped to electrical conductors of different cross sectional configurations and dimensions.

5. The electrical contact set forth in claim 4, wherein said bight edge is positioned between the base and distal portions of said arms to assure that said arms fold about the conductor adjacent to said bight edge.

6. The electrical contact set forth in claim 4, wherein the inside edges of each crimping arm include beveled surfaces to provide a camming action permitting the arms to pass one another and to encircle the conductor while remaining in substantially the same plane.

7. The electrical contact set forth in claim 6, wherein each said crimping arm has a planar dimension at its base which is less than its planar dimension along the mid portion thereof, to thereby initiate the crimping of said arms about the conductor at said bases with the conductor being held adjacent to said bight edge during and after crimping.

8. An electrical contact comprising:

a body portion having an active contact element for engagement with a complementary contact and a terminal element adapted for termination to an electrical conductor, said terminal element comprising a pair of spaced crimping arms disposed in a common plane, each arm having an inside edge comprising a beveled surface to provide a camming action permitting said arms to pass one another during the crimping operation while said arms remain in substantially the same plane, each arm also having a dimension across the base thereof sufficient to prevent collapse of said arm at said base during the crimping operation but less than the dimension across the mid portion of said arm.

9. In an electrical contact having a terminal element adapted to be crimped to an electrical conductor, the improvement comprising:

said terminal element having two spaced crimping arms disposed in a common plane and defining a slot for receiving the conductor perpendicular to said plane, said arms each having a beveled inside edge which is offset relative to the edge of the other arm in a direction perpendicular to said plan to provide a camming action during the crimping operation to permit the arms to pass one another and to fold over and encapsulate the conductor while said arms remain in generally the same plane.

10. An electrical contact adapted to be crimped to an electrical conductor, said contact comprising a body portion having an active contact element disposed at one end for engagement with a compatible contact and a terminal element at the other end adapted to be fixedly connected to a conductor, said terminal element comprising a pair of spaced crimped arms disposed in a common plane, said arms including inside facing edges having beveled surfaces such that upon crimping of said arms the beveled surfaces provide a camming action permitting said arms to pass one another to encapsulate the conductor while said arms remain in substantially the same plane, whereby the crimped arms provide a positive mechanical and electrical interconnection between the contact and the conductor, each crimping arm having a planar dimension at a mid-portion thereof greater than the planar dimension at the base thereof.

11. The electrical contact set forth in claim 10, wherein said terminal element includes a bight portion disposed between said spaced crimping arms defining an edge generally perpendicular to the inside edges of said arms such that the slot defined by the inside edges of said crimping arms and said bight is generally rectangular.

12. The electrical contact set forth in claim 10, wherein said bight edge is positioned intermediate the base and the distal end of said arms to assure that said arms fold about the associated conductor substantially adjacent to said bight edge.

13. An electrical contact adapted to be crimped to an electrical conductor, said contact comprising a body portion having an active contact element disposed at one end for engagement with a compatible contact and a terminal element at the other end adapted to be fixedly connected to a conductor, said terminal element comprising a pair of spaced crimping arms disposed in a common plane, said arms including a bight portion disposed therebetween and inside facing edges having beveled surfaces such that upon crimping of said arms the beveled surfaces provide a camming action permitting said arms to pass one another to encapsulate the conductor while said arms remain in substantially the same plane, whereby the crimped arms provide a positive mechanical and electrical interconnection between the contact and the conductor, said crimping arms including outer peripheral edges of generally circular configuration whereby the planar dimension of each arm adjacent to its base is less than the planar dimension of each arm at a mid point thereof, to thereby initiate crimping of said arms about the conductor at said bases with the conductor being held adjacent to said bight edge during and after crimping.

14. The electrical contact set forth in claim 13, wherein the point of intersection between the circular peripheral edges and said body portion defines a neck region, and the inside edges of said arms terminate at a common bight edge positioned between said neck region and the distal end of said terminal element to assure that said arms fold about the associated conductor substantially adjacent to said bight edge.

15. An electrical contact comprising:

a body portion having an active contact element for engagement with a complementary contact and a terminal element adapted for termination to an electrical conductor, said terminal element comprising a pair of spaced crimping arms disposed generally in a common plane such that upon crimping said arms will be generally perpendicular to the axis of a conductor about which the arms are crimped, each of said crimping arms having a planar dimension at its base less than the planar dimension of each arm at a mid point thereof to thereby initiate crimping of said arms about the conductor at said bases.

16. The electrical contact set forth in claim 15 including a common bight edge between said arms, said common bight being disposed intermediate the bases of said arms and distal ends of said arms, whereby said crimping of said arms about the connector at said bases is effective to hold the conductor adjacent to said common bight during and after crimping.

* * * * *